US006335587B1

(12) United States Patent
Matsubara

(10) Patent No.: US 6,335,587 B1
(45) **Date of Patent: *Jan. 1, 2002**

(54) SPARK PLUG

(75) Inventor: Yoshihiro Matsubara, Yokkaichi (JP)

(73) Assignee: NGK Spark Plug Co., Ltd., Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/401,534

(22) Filed: Sep. 22, 1999

(30) Foreign Application Priority Data

Sep. 25, 1998 (JP) ..... 10-270412
Aug. 24, 1999 (JP) ..... 11-236289

(51) Int. Cl.[7] ..... H01T 13/20
(52) U.S. Cl. ..... 313/141; 313/123; 313/142
(58) Field of Search ..... 313/141, 142, 313/144, 123

(56) References Cited

U.S. PATENT DOCUMENTS 5,693,999 A * 12/1997 Osamura et al. ..... 313/141
6,091,185 A * 7/2000 Matsubara et al. ..... 313/141 X

FOREIGN PATENT DOCUMENTS

JP 6-176849 6/1994
JP 7-73956 3/1995

* cited by examiner

*Primary Examiner*—Ashok Patel
(74) *Attorney, Agent, or Firm*—Morgan, Lewis & Bockius LLP

(57) ABSTRACT

The shortest distance (F, F') from an end face (11A) of each ground electrode (11, 11') to a porcelain insulator (1) is made smaller than the shortest distance (G, G') from the end face (11A) of each ground electrode (11, 11') to the peripheral side surface of a central electrode (2, 2'). An anti-spark consumption member (21, 22, 23, 24, 25, 26, 27, 28, 29, 30, 31, 32) is secured to a portion of the central electrode (2, 2') in such a way that it is spaced at least a specified distance (H) of from the end face of the porcelain insulator (1).

9 Claims, 13 Drawing Sheets

SPARK PLUG

BACKGROUND OF THE INVENTION

1. Field of Invention

The present invention relates to a spark plug used as an ignition device for internal combustion engines. The present invention particularly relates to a spark plug for use with high-power and high-performance internal combustion engines such as rotary engines and reciprocal engines of high compression ratio.

2. Description of the Related Art

In high-power and high-performance internal combustion engines, the standard spark plug using parallel electrodes can not be used due to not only the mechanical strength problems such as the low heat resistance and breaking of the ground electrode but also the problem of carbon fouling during vehicle running under low lead. Instead, there have been used spark plugs of a semi-surface discharge type or an intermittent semi-surface discharge type that have a plurality of ground electrodes provided to face the peripheral side surface of the central electrode. A problem with these spark plugs of a semi-surface discharge type is how to improve the spark resistance and reduce the consumption of the central electrode. According to Unexamined Japanese Patent Publication (kokai) No. 6-176849, there is provided a spark plug in which an anti-spark consumption member typically made of a platinum alloy is put around the central electrode in an area near the end face of the porcelain insulator in such a way that about one half of the anti-spark consumption member is buried in the porcelain insulator. This is effective in preventing the spark consumption of the central electrode. If the surface of the porcelain insulator is fouled with carbon, surface discharge is caused to achieve spark cleaning. The spark plug had adequate firing performance and its operating life was satisfactory at the time it was invented.

As it turned out, however, this conventional spark plug did not have a sufficient life to meet the current requirement. Heretofore, high-performance spark plugs have not been required to have a very long life and they have been held satisfactory if they can withstand running for 50,000 to 60,000 km. However, in recent years, even the high-performance spark plugs are required to have a sufficient life to withstand running for 100,000 to 120,000 km. This requirement cannot be met by the spark plug described in Unexamined Published Japanese Patent Publication (kokai) No. 6-176849 since the surface of the porcelain insulator is grooved by spark discharge. This problem called "channeling" has been found to occur for the following reasons.

In the spark plug as described in Unexamined Japanese Patent Publication (kokai) No. 6-176849, an anti-spark consumption member typically made of a platinum alloy is put around the central electrode in an area near the end face of the porcelain insulator in such a way it is partly buried in the porcelain insulator. In the spark plug, if it is new with the porcelain insulator being not fouled with carbon, about 70% of spark jumps occur between the top of the central electrode and the side ground electrode. The remaining 30% of spark jumps occur as a surface discharge that creeps on the end face of the porcelain insulator. of course, if the surface of the porcelain insulator is fouled with carbon, spark jumps exclusively occur as a surface discharge to cause the spark cleaning of the porcelain insulator.

However, after the use equivalent to running for several tens of thousand kilometers, the distal end portion of the central electrode that is not encircled with the anti-spark consumption member is consumed by spark discharge. This increases the distance between the distal end portion of the central electrode and the side ground electrode and, hence, the discharge distance is increased to make it difficult to achieve spark jumps. As a result of the spark consumption of the distal end portion of the central electrode, the nearby electrical field would have been relaxed. Consequently, the primary discharge that occurs. in the spark plug is the surface discharge that is caused by the jumping of electricity between the neighborhood of the base of the central electrode which is encircled with the anti-spark consumption member and the side ground electrode. Thus, after running for several tens of thousand kilometers, the discharge that primarily takes place in the spark plug is the surface discharge that creeps on the end face of the porcelain insulator and the progress of "channeling" is accelerated. If "channeling" progresses, the mechanical strength such as heat resistance of the spark plug is impaired or its reliability is lowered, which eventually leads to a shorter operating life of the spark plug.

SUMMARY OF THE INVENTION

It is an object of the present invention to provide a spark plug for use with high-power, high-performance internal combustion engines that has high resistance to not only fouling but also channeling to be capable of operating for a prolonged life.

A spark plug according to the present invention comprises: a porcelain insulator having a central through-hole; a central electrode held in the central through-hole, the central electrode having a distal end provided with an anti-spark consumption member; a metal shell holding the porcelain insulator; and a plurality of ground electrodes having electrical continuity to the metal shell, the plurality of ground electrodes forming a spark discharge gap from the distal end portion of the central electrode The shortest distance from the end face of each ground electrode to the porcelain insulator is smaller than the spark discharge gap. The said distal end of the central electrode projects from an end face of the porcelain insulator. The central electrode comprises a central electrode matrix in a plane coextensive with the end face of the porcelain insulator.

DETAILED DESCRIPTION OF THE INVENTION

Figure 1:
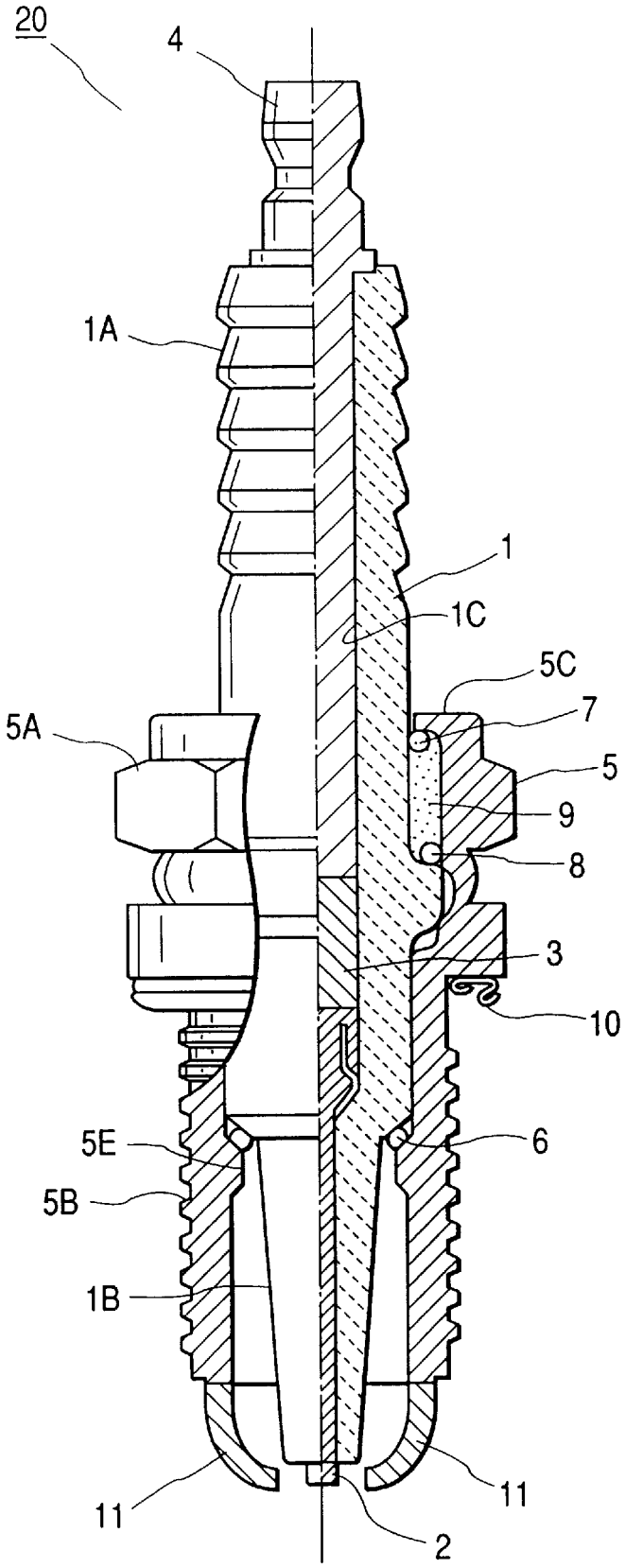
FIG. 1 is a partial section view of a spark plug according to the present invention.

The present invention will be described in detail as follows.

A spark plug according to the present invention has a porcelain insulator having a central through-hole, a central electrode held in the central through-hole, a metal shell holding the porcelain insulator and a plurality of ground electrodes having electrical continuity to the metal shell. In the spark plug, the plurality of spark plugs form a spark discharge gap from the distal end portion of the central electrode. The spark plugs are so formed that the shortest distance from the end face of each ground electrode to the porcelain insulator is smaller than the spark discharge gap. The central electrode is such that its distal end provided with an anti-spark consumption member projects from the end face of the porcelain insulator and that it is made of a central electrode matrix in a plane coextensive with the end face of the porcelain insulator.

The anti-spark consumption member may be made of any noble metal materials that have higher melting points than Inconel which is a highly corrosion-resistant nickel alloy that is commonly used as an electrode material. More specifically, the anti-spark consumption member may be made of any materials including noble metals, noble metal alloys and noble metal sinters such as platinum (Pt), platinum-iridium (Pt—Ir), platinum-nickel (Pt—Ni), platinum-iridium-nickel (Pt—Ir—Ni), platinum-rhodium (Pt—Rh), iridium-rhodium (Ir—Rh) and iridium-yttria (Ir—$Y_2O_3$).

With the construction described above, about 70% of the spark jumps that occur in a new spark plug is those between the peripheral side surface of the distal end portion of the central electrode and the end face of the side ground electrode. The remaining 30% occurs as a surface discharge that creeps on the end face of the porcelain insulator and which is caused by the jumping of electricity between the area of the central electrode that is near its base and the side ground electrode. The shortest distance from the end face of each ground electrode to the porcelain insulator is made smaller than the shortest distance from the end face of each ground electrode to the peripheral side surface of the central electrode Therefore, if the end face of the porcelain insulator is fouled with carbon, 100% of the spark jumps occur as surface discharge so that the carbon fouled end face of the porcelain insulator is subjected to spark cleaning. Because of this mechanism, the spark plug of the present invention has high resistance to fouling.

After the use comparable to vehicle running for several tens of thousand kilometers, the base of the central electrode (which is near the end face of the porcelain insulator) is consumed by the spark from surface discharge and its diameter becomes somewhat smaller. Because the central electrode is made of its matrix in a plane coextensive with the end face of the porcelain insulator, the anti-spark consumption member is secured to the central electrode in an area that is at least a specified distance spaced from the end face of the porcelain insulator. The anti-spark consumption member is not provided near the end face of the porcelain insulator. That part of the central electrode which is securely fitted with the anti-spark consumption member consumes in a relatively small amount. As a result, the discharge distance between the peripheral side surface of the central electrode near the end face of the porcelain insulator and the side ground electrode becomes longer than when the spark plug was in a brand-new state. On the other hand, the discharge distance between that part of the central electrode which is securely fitted with the anti-spark consumption member and the side ground electrode does not vary much.

After running for several tens of thousand kilometers, the discharge that primarily occurs in the spark plug is the spark discharge between that part of the central electrode which is securely fitted with the anti-spark consumption member and the side ground electrode whereas surface discharge occurs very rarely from the base of the central electrode. Thus, the progress of "channeling" is retarded and the operating life of the spark plug is extended. Further, the shortest distance from the end face of each ground electrode to the porcelain insulator is made smaller than the shortest distance from the end face of each ground electrode to the peripheral side surface of the central electrode. Therefore, if the end face of the porcelain insulator is fouled with carbon, sparks jump from the side ground electrode to the end face of the porcelain insulator and the resulting surface discharge achieves the spark cleaning of the porcelain insulator to maintain the fouling resistance of the spark plug.

In the spark plug according to the present invention, it is preferable that the end face of the porcelain insulator is preferably spaced from the anti-spark consumption member by a distance of at least 0.2 mm.

Accordingly, even if the frequency of spark jumps from the anti-spark consumption member to the side ground electrode increases when the base of the central electrode is consumed by sparks or when the surface of the anti-spark consumption member is oxidized or otherwise roughened, the chance of the porcelain insulator of becoming damaged by spark discharge to cause "channeling" is reduced.

In the spark plug, it is preferable that the diameter of the central electrode is preferably not more than 2 mm.

This structure has the advantage of allowing carbon fouling to be eliminated by spark cleaning during the process of surface discharge in which spark discharge occurs on the end face of the porcelain insulator. Another advantage is an improved firing performance of the spark plug.

In the spark plug, it is preferable that the distal end of the central electrode is located between the edge of the end face of each of the ground electrodes that is closer to the distal end of the spark plug and the opposite edge of the end face.

With this structure, the discharge that primarily occurs in the spark plug is one between the distal end of the central electrode and the end face of the side ground electrode and surface discharge occurs only intermittently on the end face of the porcelain insulator. This phenomenon occurs irrespective of whether the spark plug is of an intermittent semi-surface discharge type in which the end face of each ground electrode is located closer to the distal end of the spark plug than the porcelain insulator or of a semi-surface discharge type in which the porcelain insulator is located between the end face of each ground electrode and the central electrode. As a result, the end face of the porcelain insulator is impaired by sparks at a lower frequency and the spark plug has adequate resistance to "channeling". As a further advantage, the shortest distance from the end face of each ground electrode to the porcelain insulator is smaller than the shortest distance from the end face of each ground electrode to the peripheral surface of the central electrode. Therefore, if the surface of the porcelain insulator is fouled with carbon, semi-surface discharge positively occurs to ensure that the surface of the porcelain insulator is subjected to spark cleaning.

In the spark plug, it is preferable that each ground electrode is set to be spaced from the porcelain insulator by a distance of at least 0.3 mm.

With this design, a carbon bridge is less likely to form between each ground electrode and the end face of the porcelain insulator when carbon fouling occurs and the spark plug becomes correspondingly more resistant to carbon fouling at cold start-up.

In the spark plug, it is preferable that the end face of the porcelain insulator is shaped like an inverted cone that is gouged toward the central electrode.

With this design, the distance over which surface discharge occurs on the end face of the porcelain insulator increases to make the spark plug correspondingly more resistant to carbon fouling and, hence, "channeling". If the only purpose is to increase the distance over which surface discharge occurs on the end face of the porcelain insulator, the latter may be shaped like a cone rather than an inverted cone. In fact, however, the conical shape is vulnerable to "channeling" since the angle at which the end face of the porcelain insulator is exposed to the spark discharge from the side ground electrode is near 90 degrees.

In the spark plug, it is preferable that the diameter of the central electrode is greater at the distal end than at the end face of the porcelain insulator.

With this design, spark discharge primarily occurs in the distal end portion of the central electrode where the discharge gap is small and the frequency of the spark discharge that occurs near the base of the central electrode is so small that the spark plug has increased resistance to "channeling". Another advantage is improved firing performance in the combustion chamber.

In the spark plug, it is preferable that the anti-spark spark consumption member is secured to or near the distal end of the central electrode.

With this design, if the peripheral surface of the central electrode undergoes spark consumption as a result of running for a considerable period of time, the spark jump from the anti-sparkspark consumption member to the distal end of the central electrode becomes predominant to make the spark plug more resistant to "channeling". In addition, the spark has improved firing performance in the combustion chamber.

In the spark plug, it is preferable that the axial position of the end face of the porcelain insulator is between the edge of the end face of each ground electrode that is closer to the distal end of the spark plug and the opposite edge of the end face and the axial distance from the end face of the porcelain insulator to the opposite edge of the end face of each ground electrode is at least 40% of the thickness of the end face of each ground electrode (i.e., the distance between the edge of the end face that is closer to the distal end of the spark plug and the opposite edge of the end face).

With this design, spark discharge is more likely to jump to the edge of the end face of each ground electrode that is closer to the distal end of the spark plug whereas sparks are less likely to have intimate contact with the surface of the porcelain insulator; as the result, the spark plug has greater resistance to "channeling".

Various preferred embodiments of the present invention are described below with reference to the accompanying drawings.

FIG. 1 is a partial section of a spark plug 20 according to the present invention. A porcelain insulator 1 typically made of alumina has a corrugated upper portion 1A for ensuring a sufficient distance for surface discharge and an elongated lower leg portion 1B that is to be exposed in the combustion chamber of an internal combustion engine. A central through-hole 1C extends axially through the porcelain insulator 1. A central electrode 2 made of a nickel alloy such as Inconel is held at the bottom end (the distal end) of the central through-hole 1C and extends downward from the bottom end face of the porcelain insulator 1. In practice, the central electrode 2 is not made of Inconel alone but a copper (Cu) core is inserted in the center to provide higher thermal conductivity although it is not shown to avoid complexity in the drawing. The central electrode 2 is electrically connected to a top terminal 4 via a glass resistor 3 provided within the central through-hole 1C. A high-voltage withstanding cable (not shown) is connected to the terminal 4 so that high voltage is applied thereto. The porcelain insulator 1 is enclosed and supported with a metal shell 5.

The metal shell 5 is made of a low-carbon steel material and has a hexagonal portion 5A that fits a spark plug wrench and a threaded portion 5B that threads into a cylinder head. The metal shell 5 also has a clamp portion 5C which allows it to be clamped to the porcelain insulator 1 to provide an integral assembly of the two members. To ensure complete seal by clamping, a plate of packing member 6 is provided between a step 5E on the inner periphery of the metal shell 5 and the porcelain insulator 1 so that the extended leg portion 1B to be exposed in the combustion chamber will have a complete seal with the upper portion of the porcelain insulator 1. Wires of seal member 7 and 8 are provided between the clamp portion 5C and the porcelain insulator 1. The gap between the two seal members 7 and 8 is filled with the particles of talc 9 to provide a seal elastic enough to ensure that the metal shell 5 is positively fixed to the porcelain insulator 1. Of course, the spark plug may be of a talc-free type. A gasket 10 is fitted between the hexagonal portion 5A and the threaded portion 5B. Two ground electrodes 11 made of a nickel alloy are welded to the bottom end of the metal shell 5. The ground electrodes 11 are so formed that their end faces are opposed to the peripheral side surface of the central electrode 2.

Figure 2:
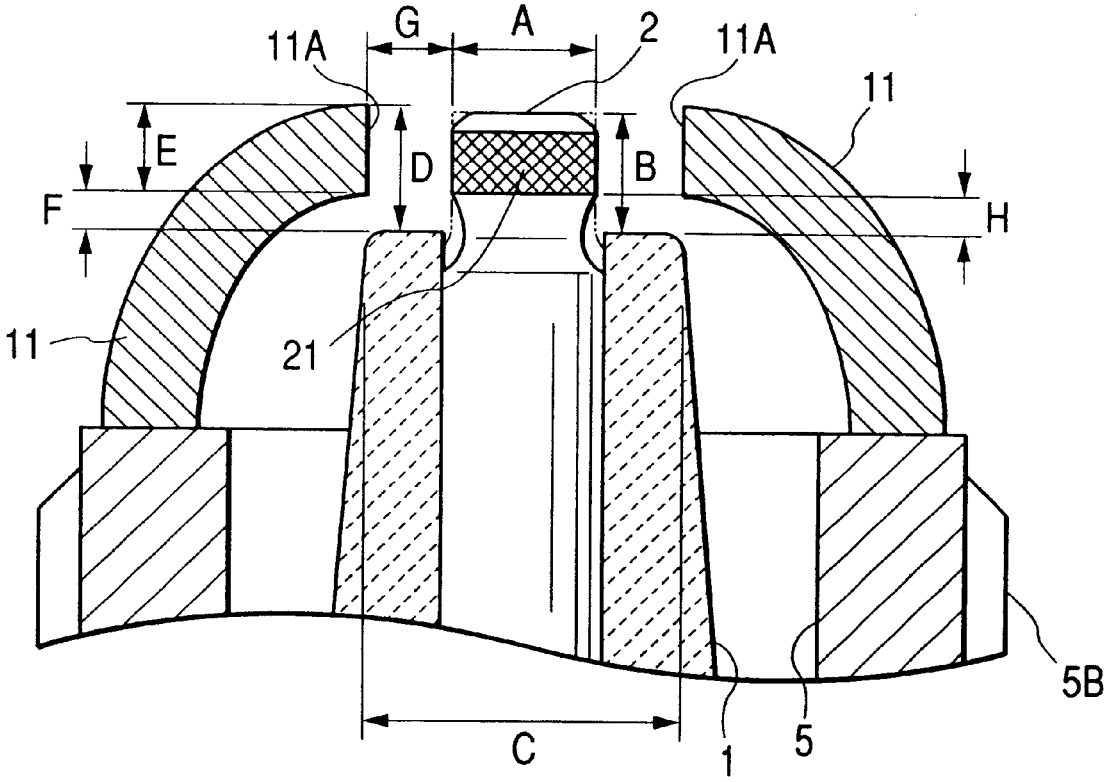
FIG. 2 is a section view showing enlarged a distal end portion of a spark plug according to a first embodiment of the present invention.

Details of the dimensions of the individual parts shown in FIG. 2 are given below. The central electrode 2 has a diameter of A which is equal to 2.0 mm (all dimensions that are discussed below are in millimeters); the central electrode 2 projects from the porcelain insulator 1 by an amount of B which is equal to 1.8; the end face of the porcelain insulator 1 has a diameter of C which is equal to 4.6. The distance D from the end face of the porcelain insulator 1 to the edge of the end face 11A of each ground electrode 11 that is closer to the distal end of the spark plug (and which is shown at the top of FIG. 2) is equal to 2.1 (the dimension is hereunder referred to as the amount of projection D of each ground electrode). The thickness E of each ground electrode 11 (i.e., the distance from the upper edge of the end face 11A of each ground electrode to the lower edge, as shown in FIG. 2, of the end face) is equal to 1.6. The distance F from the lower edge of the end face 11A of each ground electrode 11 to the end face of the porcelain insulator 1 (which dimension is hereunder referred to as the semi-surface discharge air gap F) is equal to 0.5. The distance G from the end face 11A of each ground electrode 11 to the peripheral side surface of the central electrode 2 (which dimension is hereunder referred to as the side electrode air gap G) is equal to 1.3. The distance H by which the end face of the porcelain insulator 1 is spaced from the anti-sparkspark consumption member 21 is equal to 0.5.

The semi-surface discharge gap F is smaller than the side electrode air gap G. The distance H by which the end face of the porcelain insulator is spaced from the anti-spark spark consumption member is 0.5 which is greater than 0.2. The diameter A of the central electrode is 2.0. The amount of projection D of each ground electrode is greater than the amount of projection B of the central electrode and (D-B) is smaller than the thickness E of the each ground electrode. Further, the semi-surface discharge air gap F is 0.5 which is greater than 0.3. Experiments were conducted to compare the endurance of this spark plug with that of two conventional spark plugs.

Figure 3A:
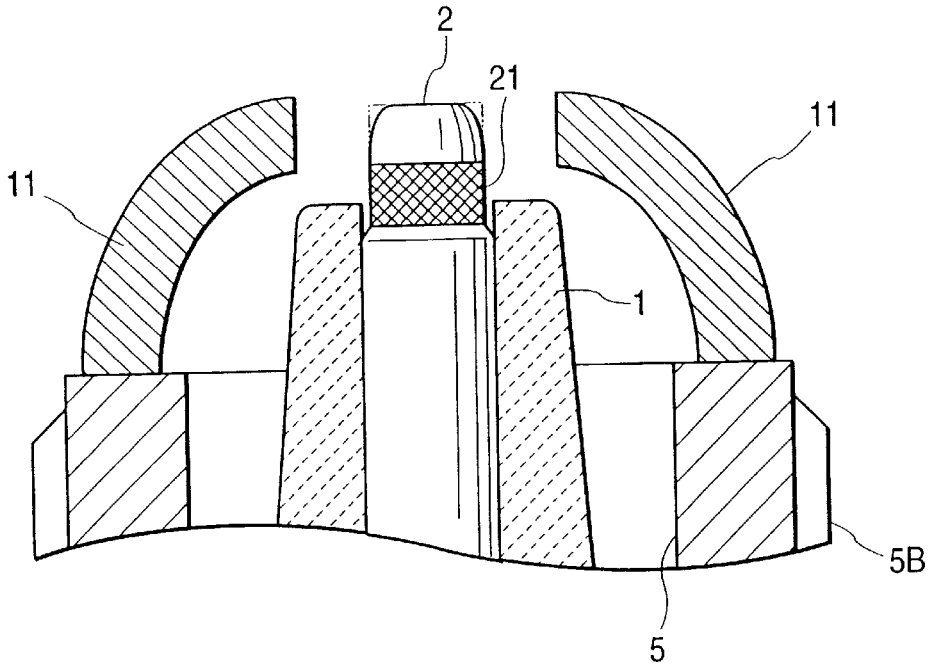
CONVENTIONAL ART FIG. 3A
FIGS. 3A and 3B are sectional views showing enlarged a distal end portion of a conventional spark plug.
Figure 3B:
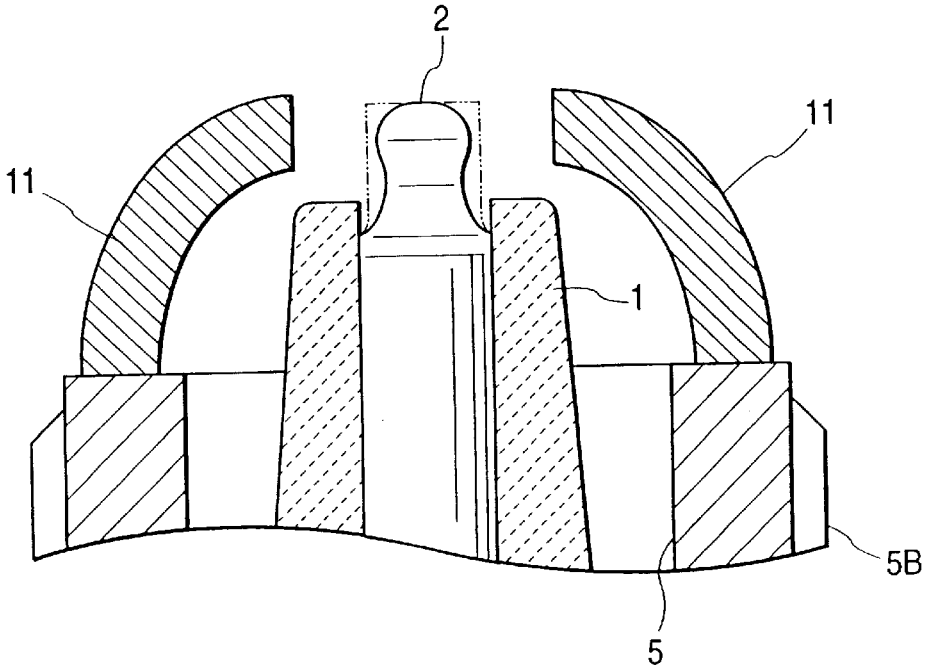
CONVENTIONAL ART FIG. 3B

FIGS. 3A and 3B show in section the distal end portions of the two conventional spark plugs used in the comparative experiments. The spark plug shown in FIG. 3A has the anti-spark consumption member (Pt) 21 secured to the peripheral side surface of the central electrode 2 in such a way that it is partly buried in the porcelain insulator 1. This conventional spark plug is called spark plug B. The spark plug shown in FIG. 3B has no anti-spark consumption member attached to the central electrode 2, which is solely made of a nickel alloy (95 wt % Ni). This conventional spark plug is called spark plug C. The spark plug of the present invention which is shown in FIG. 2 is called spark plug A. The three spark plugs are formed in entirely the same dimensions and the only difference concerns whether the anti-spark consumption member is used or in which position it is secured if it is used. In FIGS. 3A and 3B, the central electrode 2 is indicated by a solid line to show somewhat exaggerated a worn state that results from running for several tens of thousand kilometers and by a two-short-and-one-long dashed line to show a brand-new state, as similar to FIG. 2.

Figure 4:
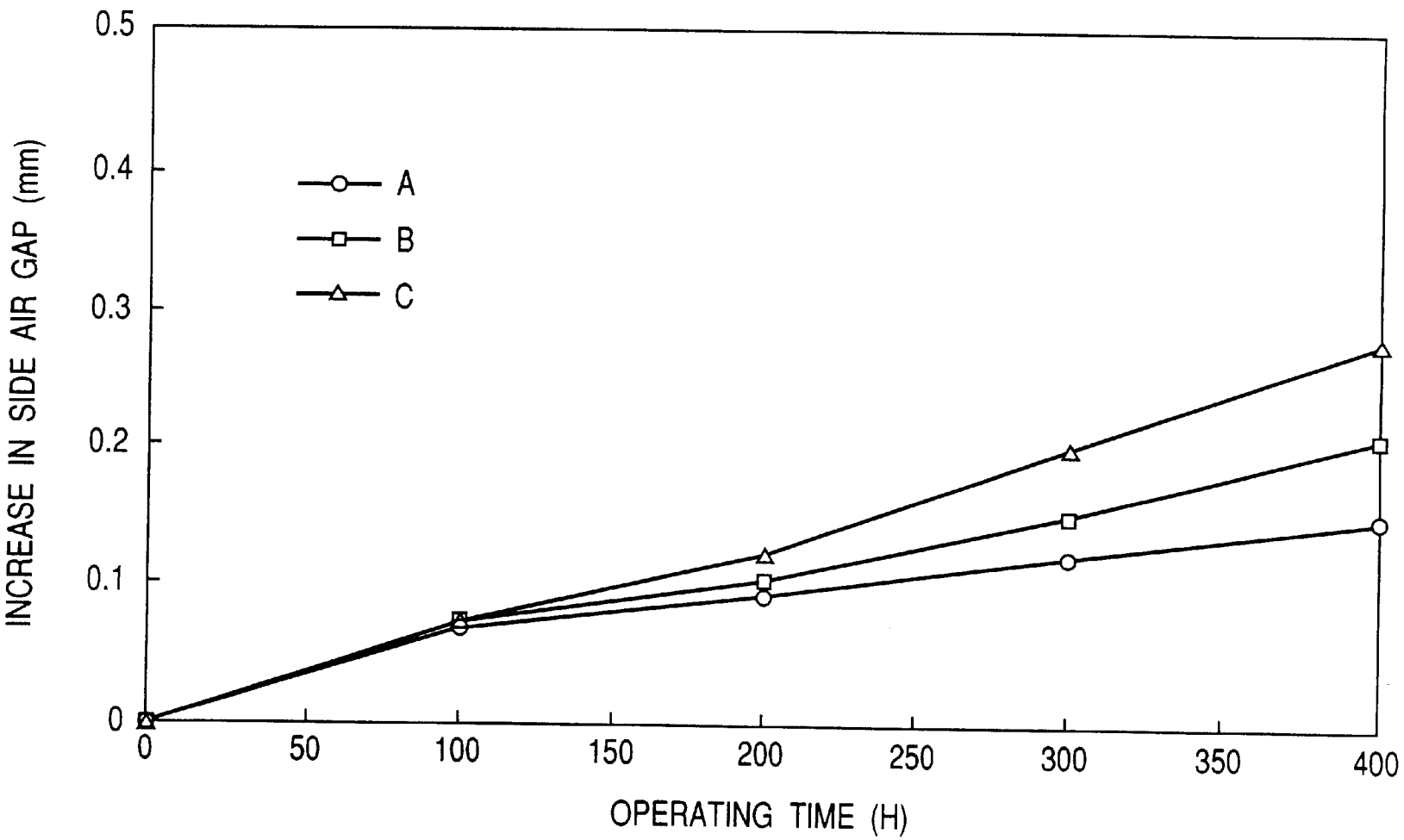
FIG. 4 is a graph showing a relationship between an increase in a side air gap G and an operating time.
Figure 5:
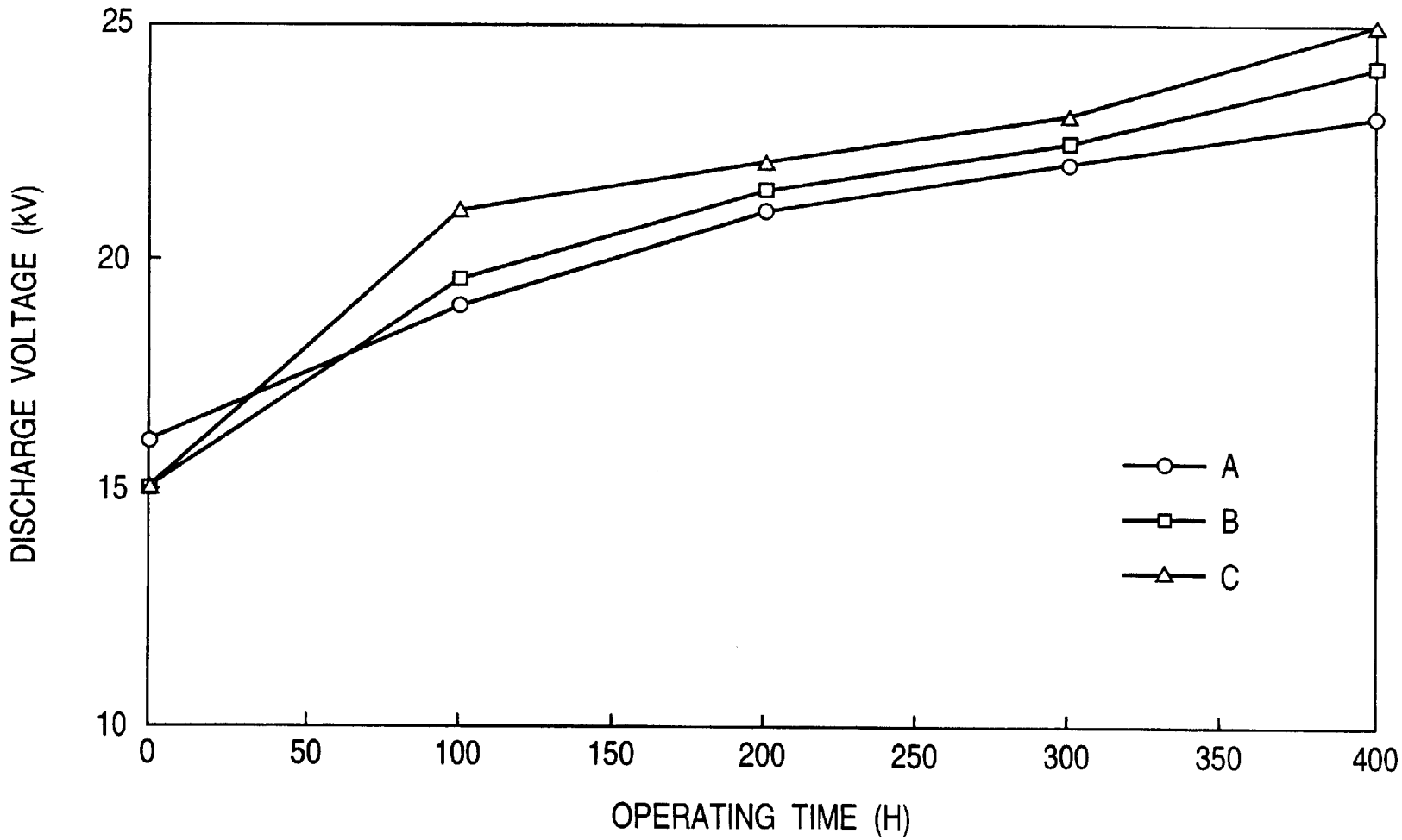
FIG. 5 is a graph showing a relationship between a discharge voltage and an operating time.

FIGS. 4 and 5 show the results of on-board endurance tests. The test spark plugs were operated on an in-line, 6-cylinder, 2-liter engine which was run in a full throttle (WOT: wide open throttle) condition at 5,000 rpm. This operation was equivalent to running at about 170 km per hour; an endurance time of 300 h was equivalent to running for 50,000 km and an endurance time of 600 h to running for 100,000 km. In both FIGS. 4 and 5, ○ refers to the data for spark plug A (the invention sample), □ refers the data for spark plug B (the conventional sample with Pt), and Δ refers the data for spark plug C (the conventional sample without Pt).

FIG. 4 is a graph showing the relationship between the increase in the side air gap G and the operating time. When the operating time exceeded 200 h, the data for the three spark plugs started to diverge and at 400 h, the divergence was substantial. Up to 600 h, the data for the three spark plugs shifted generally parallel to each other. At any operating hour, the spark plug A of the invention experienced the smallest increase in the side air gap G and had the highest endurance. The spark plug B was worse and the spark plug C was the worst.

FIG. 5 is a graph showing the relationship between the discharge voltage and the operating time. The discharge voltage was evaluated in terms of a momentary maximal discharge voltage that occurred during idle racing (idling followed by racing). In a brand-new state, the spark plug A of the invention showed a higher discharge voltage than the conventional spark plugs B and C. As the operation continued, the tendency reversed and when the operating time exceeded 100 h, spark plug A had the lowest discharge voltage, followed by the spark plugs B and C. This tendency continued up to an operating time of 600 h. The increase in the discharge voltage of spark plug A gradually decreased. The discharge voltages of the spark plugs B and C also increased from an operating time of 200 h to 300 h but in the period from 300 h to 600 h, the increase in the discharge voltage tended to increase somewhat. These results also show that the spark plug A of the invention is more durable than the spark plugs B and C.

The spark plugs A, B and C that were subjected to the endurance tests for 600 h were also investigated for their anti-channeling and other characteristics. The results are shown in Table 1 below, from which one can see that during carbon fouling of the porcelain insulator 1, the spark jump to cause semi-surface discharge was 100% in each spark plug. In other words, at every operating time, the carbon fouling caused electricity to jump from the side ground electrode 11 to the edge of the end face of the porcelain insulator 1, whereupon sparks crept on the end face to reach the central electrode 2. As a result, the carbon deposit on the surface of the porcelain insulator was burned clean by the sparks and the carbon fouled insulator was positively spark cleaned.

TABLE 1

| Spark plug | A | B | C |
|---|---|---|---|
| Spark jump to cause semi-surface discharge during carbon fouling | 100% | 100% | 100% |
| Spark jump in the upper part of the central electrode at 50,000 km (300 h) | 90% | 35% | 55% |
| channeling at 100,000 km (600 h) | ⊙ | Δ | Δ |

The spark jump that occurred in the upper part of the central electrode 2 after running for 50,000 km (300 h) was 90% in the spark plug A, 35% in the spark plug B and 55% in the spark plug C. The remaining spark jump occurred near the base of the central electrode 2, causing semi-surface discharge on the end face of the porcelain insulator 1. As shown in FIG. 2, the spark plug A had the anti-spark consumption member (Pt) 21 secured to the central electrode 2 in an area that was spaced from the end face of the porcelain insulator 1 by the specified distance H=0.5 mm. Hence, as the result of running for the first 50,000 km, the area of the central electrode 2 that was near the base and which did not have the anti-spark consumption member 21 was grooved by spark consumption. As the result, the distance from each ground electrode 11 to the anti-spark consumption member 21 on the central electrode 2 became shorter than the distance from each ground electrode 11 to the area of the central electrode 2 near the base and the spark jump to the anti-spark consumption member 21 remote from the porcelain insulator 1 would have become predominant (accounting for 90% of the spark jumps that occurred in the spark plug). Another postulation is that the grooving of the central electrode 2 in the area near the base relaxed the electric field in that area.

As shown in FIG. 3A, the spark plug B had the anti-spark consumption member (Pt) 21 secured to the central electrode 2 in such a way that it was partly buried in the porcelain insulator 1. In a manner opposite to the case of the spark plug A, the distal end portion of the central electrode 2 was consumed by sparks after running for the first 50,000 km. As the result, the distance from each ground electrode 11 to the distal end portion of the central electrode 2 increased or the electric field in the distal end portion of the central electrode 2 was relaxed, eventually causing the spark jump to the distal end portion of the central electrode 2 to drop to 35%. Instead, the spark jump to that area of the central electrode 2 which was near its base and covered with the anti-spark consumption member 21 became predominant.

As shown in FIG. 3B, the spark plug C had no anti-spark consumption member secured to the central electrode 2. Accordingly, both the base and the distal end portion of the central electrode 2 was the result of running for the first 50,000 km. The spark jump to the distal end portion of the central electrode 2 accounted for 55% of the spark jumps that occurred in the spark plug. In other words, the spark jumps were distributed in almost equal proportions between the distal end portion of the central electrode and its base portion.

Next, the depth of the channeling groove forming in the surface of the porcelain insulator 1 after running for 100,000 km (600 h) was measured by examination with a scanning electron microscope. The following criteria were used to evaluate the results of examination including those of the testing described later that was performed to determine an optimal value of distance H: slight (◎), the groove depth was less than 0.2 mm; small (○), 0.2 to 0.3 mm; moderate (Δ), 0.3 to 0.4 mm; extensive (X), more than 0.4 mm.

The spark plug A of the present invention was rated ◎ and only slight channeling occurred on several occasions. On the other hand, the conventional spark plugs B and C were rated Δ and shallow channeling occurred. These results are the natural consequence of the aforementioned data for the spark jump in the upper part of the central electrode that occurred after running for 50,000 km.

Then, in order to determine an optimal value of distance H, there were prepared various samples of spark plug the individual parts of which had the same dimensions as in the spark plug A and in which H was varied as 0, 0.1, 0.2, 0.3 and 0.4. These samples were subjected to an on-board endurance test for 600 h under the conditions already described above. The anti-channeling characteristics of the porcelain insulator 1 thus tested are shown in Table 2 below.

TABLE 2

| H | 0 | 0.1 | 0.2 | 0.3 | 0.4 |
|---|---|---|---|---|---|
| Channeling | Δ | ○ | ◎ | ◎ | ◎ |

As is clear from Table 2, substantial channeling occurred when H=0 mm or in the case where the anti-spark consumption member (Pt) 21 was secured to the central electrode 2 in a plane coextensive with the end face of the porcelain insulator 1. When H=0.1 mm, the degree of channeling somewhat lessened and when H was 0.2 mm or more, the occurrence of channeling was negligible.

As described above, according to the first embodiment of the present invention as shown in FIG. 2, there is provided a spark plug of an intermittent semi-surface discharge type that has the advantages of high resistance to channeling, high durability and high resistance to carbon fouling during running under low load (see the graphs in FIGS. 4 and 5 and the data in Table 1). Preferably, the end face of the porcelain insulator 1 is spaced from the anti-spark consumption member 21 by distance H of at least 0.2 mm.

It should be noted that the embodiment shown in FIG. 2 is not the sole case of the invention and various modifications are conceivable as will be described below.

Figure 6A:
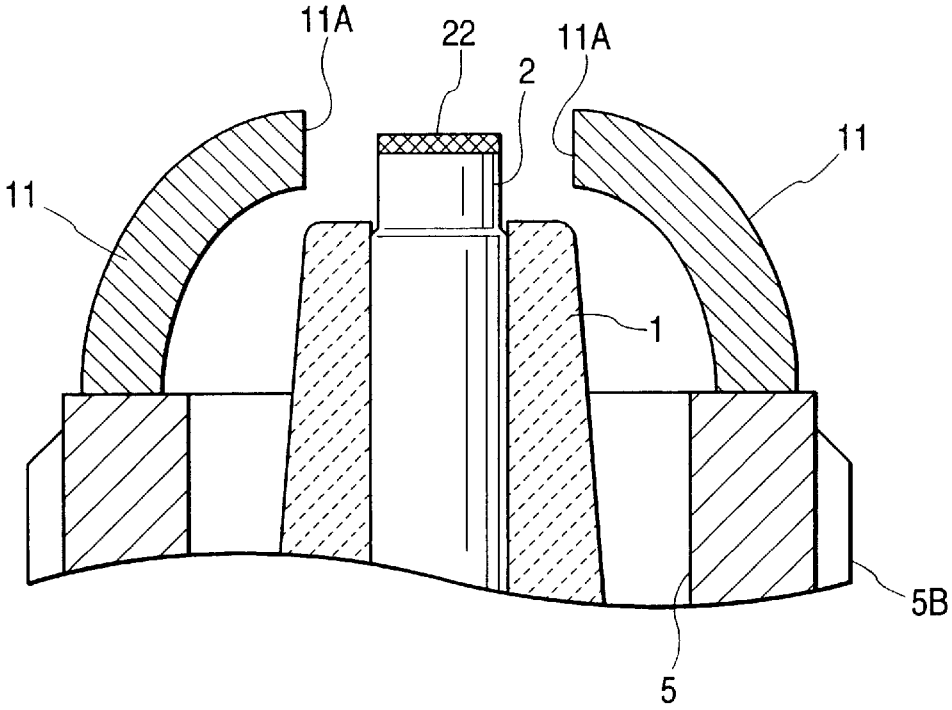
FIG. 6A is a section view showing enlarged a distal end portion of a spark plug according to a second embodiment of the present invention.

FIG. 6A is a section view of the distal end portion of a spark plug according to a second embodiment of the present invention. In this spark plug, a disk of anti-spark consumption member (Pt) 22 is secured to the tip, rather than the peripheral side surface, of the central electrode 2 by resistance welding. The second embodiment is otherwise the same as the first embodiment shown in FIG. 2.

With this design, the peripheral side surface of the central electrode 2 slightly decreases in diameter due to the spark consumption resulting from running for several tens of thousand kilometers. Since the diameter of the anti-spark consumption member 22 at the tip of the central electrode 2 remains substantially the same, spark jumps are concentrated in the distal end portion of the central electrode 2 and remote from the porcelain insulator 1. The spark plug hence has high resistance to.channeling. If the porcelain insulator 1 is fouled, electricity jumps from each ground electrode 11 to the porcelain insulator 1 and the resulting semi-surface discharge accomplished spark cleaning. In the second embodiment, the distal end portion of the central electrode where an electric field tends to become concentrated maintains its shape. Accordingly, the chance of spark jumps in that distal end portion increases to a higher value and the resistance to channeling, hence, the operating life of the spark plug is correspondingly increased. As a further advantage, the occurrence of spark jumps in the distal end portion of the central electrode improves the firing performance of the spark plug.

Figure 6B:
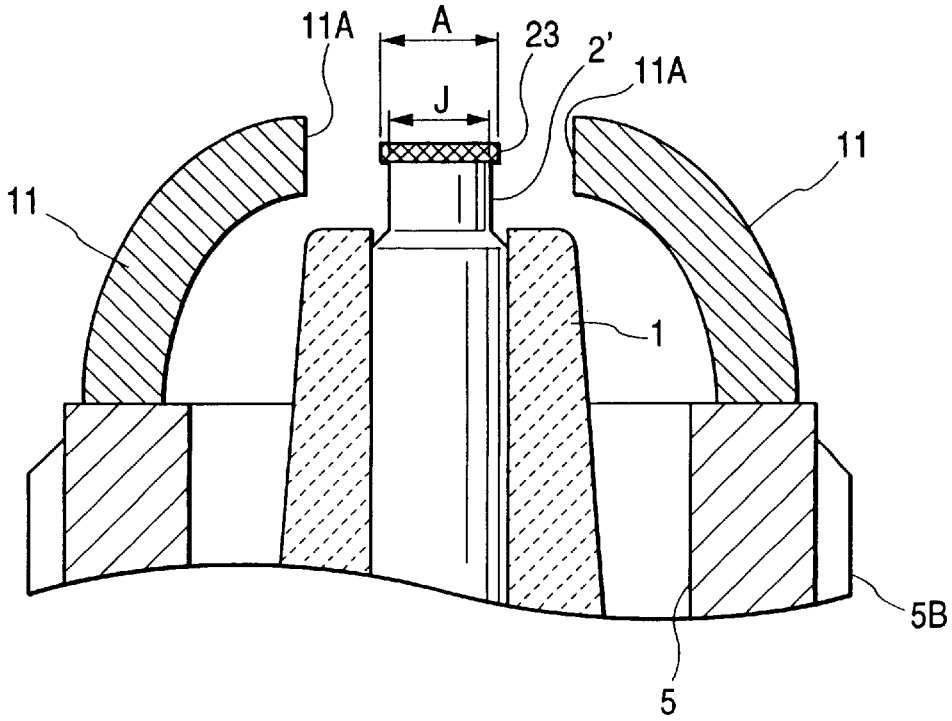
FIG. 6B is a section view showing enlarged a distal end portion of a spark plug according to a third embodiment of the present invention.

FIG. 6B is a section of the distal end portion of a spark plug according to a third embodiment of the present invention. In this embodiment, the diameter of the exposed part of the central electrode is made smaller in all areas except the distal end portion. The small-diameter portion of the central electrode 2' has a diameter of J which is equal to 1.6 mm, a value 0.4 mm smaller than the inherent diameter A of the central electrode 2' which is equal to 2.0 mm. A disk of anti-spark consumption member (platinum Pt) 23 having a diameter of 2.0 mm is secured to the tip of the central electrode 2' by resistance welding. The third embodiment is otherwise the same as the second embodiment shown in FIG. 6A.

With this design, in as early as the initial stage of vehicle running, spark jumps are concentrated in the anti-spark consumption member 23 in the distal end portion of the central electrode 2' where the discharge gap is small enough to permit the concentration of an electric field and the frequency of spark jumps that occur near the base of the central electrode 2' is considerably reduced. As a result, the resistance to channeling is increased so that the operating life of the spark plug is correspondingly increased, and the added advantage of good firing performance is attained.

The diameter J of the small-diameter portion of the central electrode 2' is preferably made smaller than its inherent diameter A by 0.2 to 1.0 mm, more preferably 0.3 to 0.6 mm. The diameter J is preferably at least 1.0 mm to meet the requirement for securing the strength of the central electrode 2'.

Figure 7:
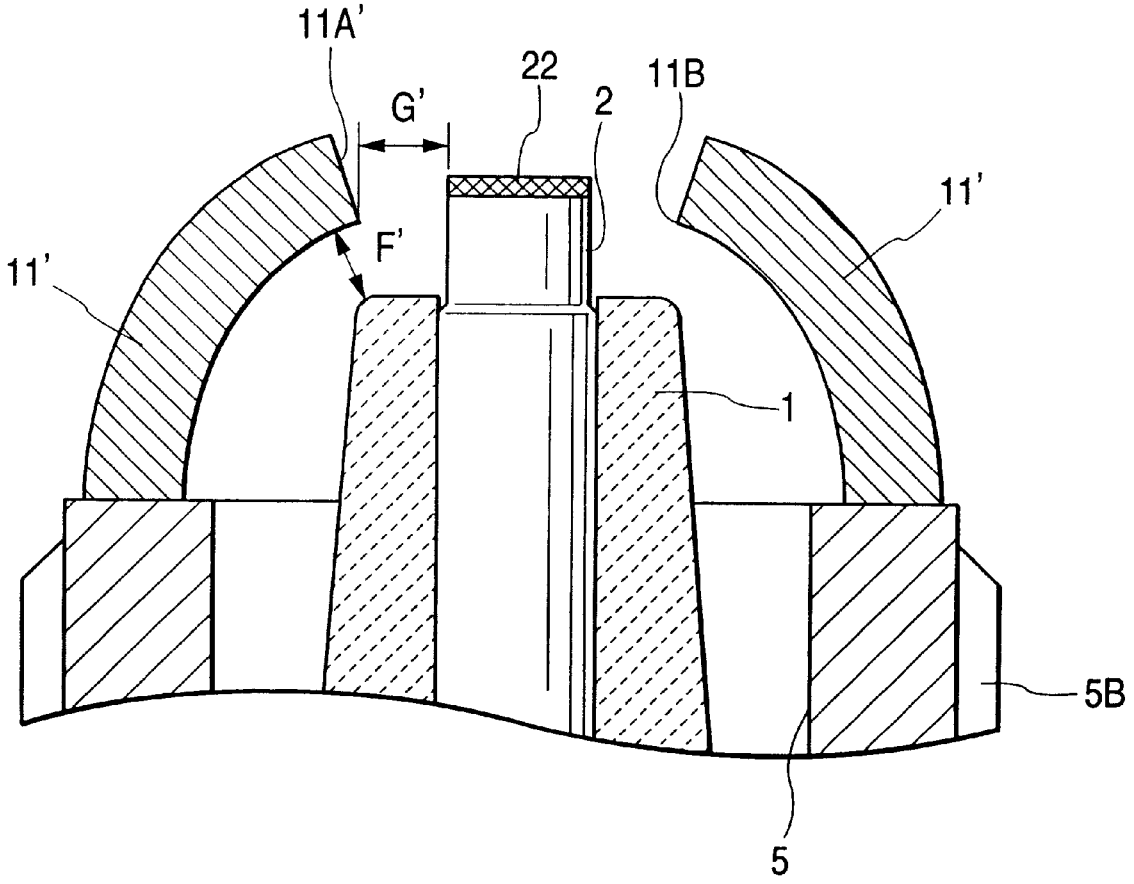
FIG. 7 is a section view showing enlarged a distal end portion of a spark plug according to a fourth embodiment of the present invention.

FIG. 7 is a section view of the distal end portion of a spark plug according to a fourth embodiment of the present invention. In the spark plug, the end face 11A' of each ground electrode 11' is oblique with respect to the peripheral side surface of the central electrode 2. The shortest distance F' from each ground electrode 11' to the porcelain insulator 1 is made smaller than the shortest distance G' from the lower edge 11B, as seen in FIG. 7, of the end face 11A' of each ground electrode 11' to the peripheral side surface of the central electrode 2. The fourth embodiment is otherwise the same as the second embodiment shown in FIG. 6A.

With this design, in as early as the initial stage of vehicle running, spark jumps are concentrated in the area between the lower edge 11B of the end face 11A' of each ground electrode 11' and the peripheral side surface of the central electrode 2 where the discharge gap is small enough to permit the concentration of an electric field and the frequency of spark jumps that occur near the base of the central electrode 2 is considerably reduced. In addition, the peripheral side surface of the central electrode 2 slightly decreases in diameter due to the spark consumption resulting from running for several tens of thousand kilometers. Since the diameter of the anti-spark consumption member 22 at the tip of the central electrode 2 remains substantially the same, spark jumps are more concentrated in the distal end portion of the central electrode 2. The spark plug hence has high resistance to channeling. If the porcelain insulator 1 is fouled, electricity jumps from each ground electrode 11' to the porcelain insulator 1 and the resulting semi-surface discharge accomplishes spark cleaning.

In the fourth embodiment, the distal end portion of the central electrode where an electric field tends to become concentrated maintains its shape. Accordingly, the chance of spark jumps in that distal end portion increases to a higher value and the resistance to channeling. Hence, the operating life of the spark plug is correspondingly increased. As a further advantage, the occurrence of spark jumps in the distal end portion of the central electrode improves the firing performance of the spark plug.

Figure 8A:
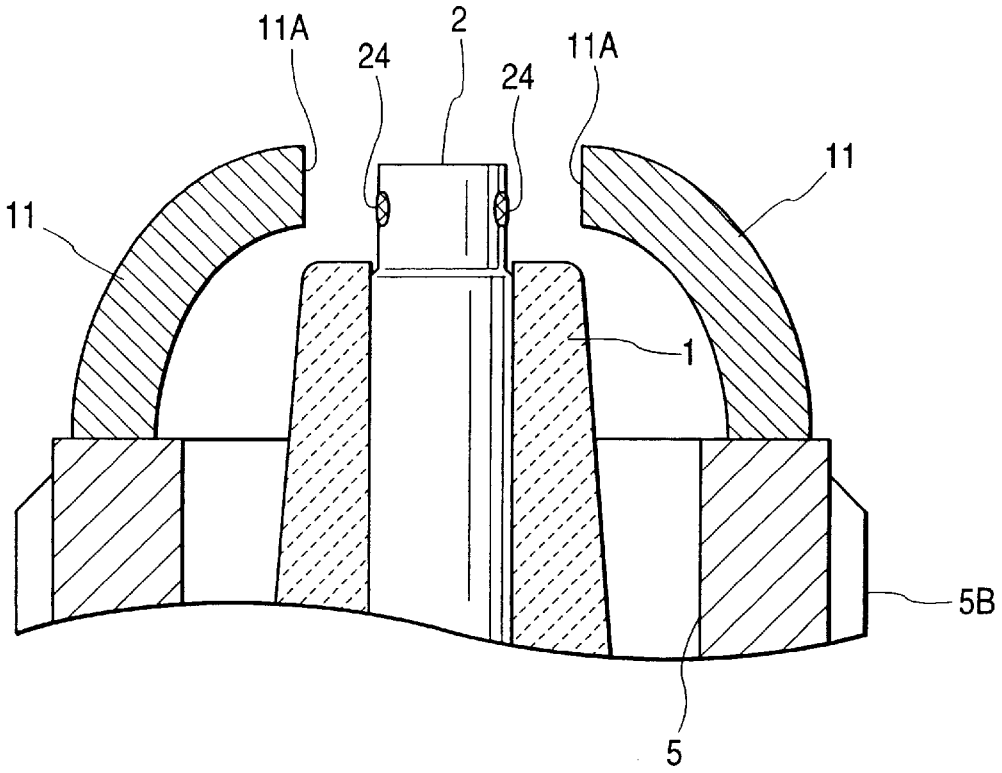
FIG. 8A is a section view showing enlarged a distal end portion of a spark plug according to a fifth embodiment of the present invention.
Figure 8B:
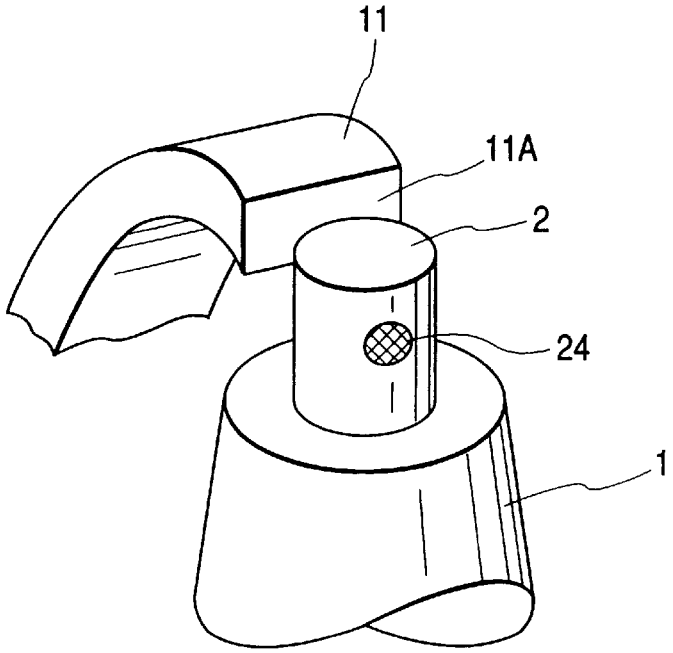
FIG. 8B is a perspective view showing enlarged a distal end portion of s spark plug according to the fifth embodiment of the present invention.

FIGS. 8A and 8B show a fifth embodiment of the invention. FIG. 8A is a section view of the distal end portion of a spark plug according to the fifth embodiment. FIG. 8B is a perspective view of the distal end portion. In the fifth embodiment, a band of anti-spark consumption member 21 is not provided around the entire peripheral side of the central electrode 2 as in the first embodiment shown in FIG. 2. Instead, two circular anti-spark consumption members 24 made of platinum (Pt) are provided in those areas of the central electrode 2 which are opposed to the end faces 11A of the two ground electrodes 11 and secured to those areas by laser welding.

The fifth embodiment has the advantage of using a smaller amount of the expensive anti-spark consumption member.

Figure 9A:
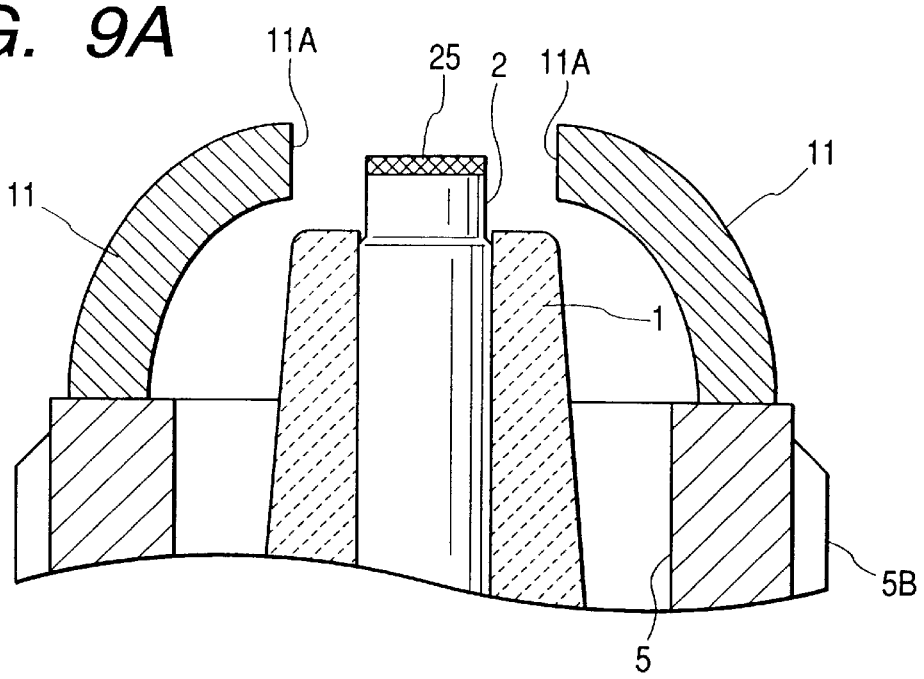
FIG. 9A is a section view showing enlarged a distal end portion of a spark plug according to a sixth embodiment of the present invention.
Figure 9B:
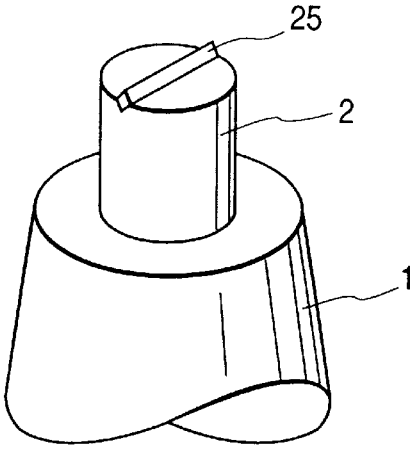
FIGS. 9B to 9D are perspective views showing distal end portion of a center electrode.
Figure 9C:
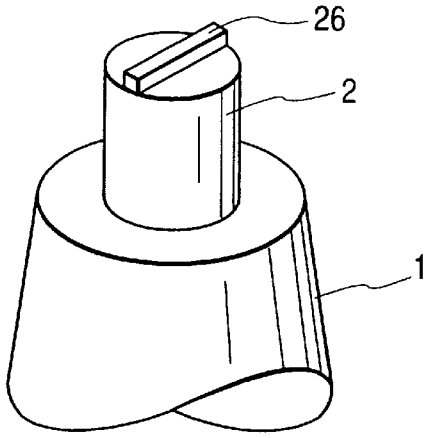
Figure 9D:
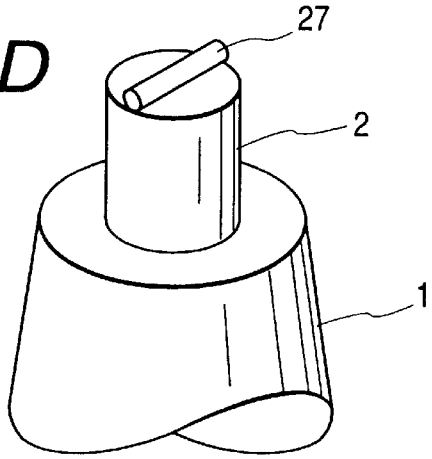

FIGS. 9A to 9D show a sixth embodiment of the invention. FIG. 9A is a section view of the distal end portion of a spark plug according to the sixth embodiment. FIGS. 9B, 9C and 9D are perspective views of three versions of the anti-spark consumption member. In the sixth embodiment, the disk of anti-spark consumption member 22 is not provided on the entire surface of the distal end face of the central electrode 2 as in the second embodiment shown in FIG. 6A. Instead, a bar of anti-spark consumption member 25 is put on the distal end face of the central electrode 2 and, with its end portions being opposed to the end faces 11A of the ground electrodes 11, the anti-spark consumption member 25 is secured by laser welding or resistance welding. In FIG. 9B, a prism of anti-spark consumption member 25 is secured in such a way that one of its ridgelines is in contact with the distal end face of the central electrode 2. In FIG. 9C, a prism of anti-spark consumption member 26 is also secured, provided that one of its sides is in contact with the distal end face of the central electrode 2. In FIG. 9D, a cylinder of anti-spark consumption member 27 is secured in such a way that part of its peripheral side is in contact with the distal end face of the central electrode 2.

Although not shown in FIGS. 9A to 9D, the bars of anti-spark consumption member 25, 26 and 27 may be provided in such a way that both end portions project slightly outward of the peripheral side surface of the central electrode 2.

The sixth embodiment described above has the advantage of using a smaller amount of the expensive anti-spark consumption member. As a further advantage, an electric field tends to concentrate in the end portions of the bar of anti-spark consumption member 25, 26 or 27. Accordingly, more spark jumps occur in these end portions of the anti-spark consumption member.

Figure 10A:
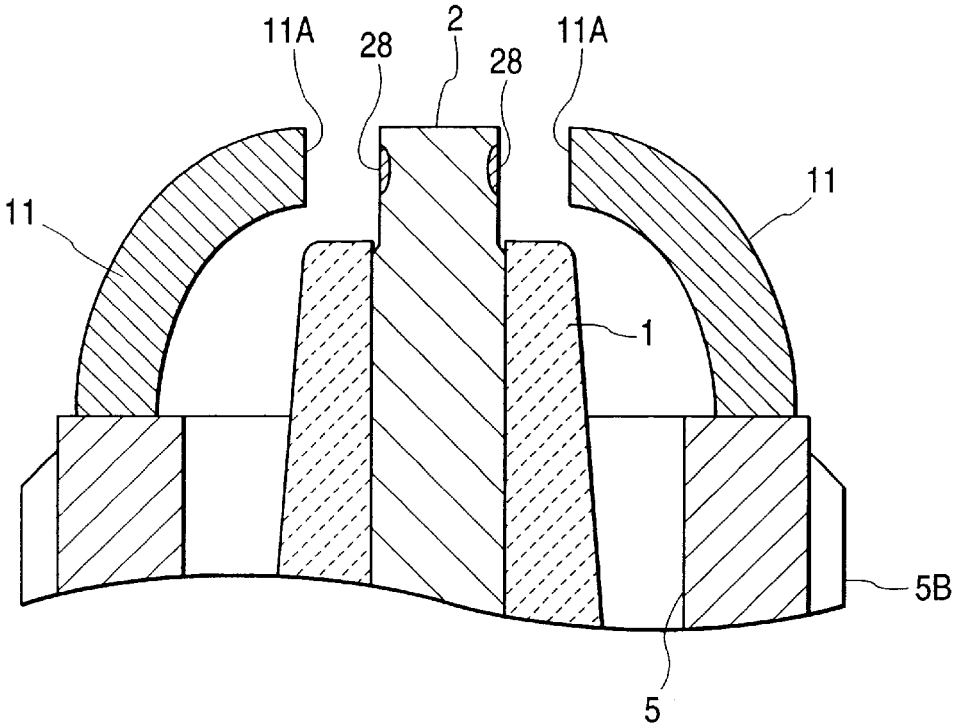
FIG. 10A is a section view showing enlarged a distal end portion of a spark plug according to a seventh embodiment of the present invention.

FIG. 10A shows a seventh embodiment of the present invention. In this spark plug, a girdle of anti-spark consumption member 28 made of platinum (Pt) is laser welded to the peripheral side of the central electrode 2 in positions that are opposed to the end faces 11A of the ground electrodes 11.

Figure 10B:
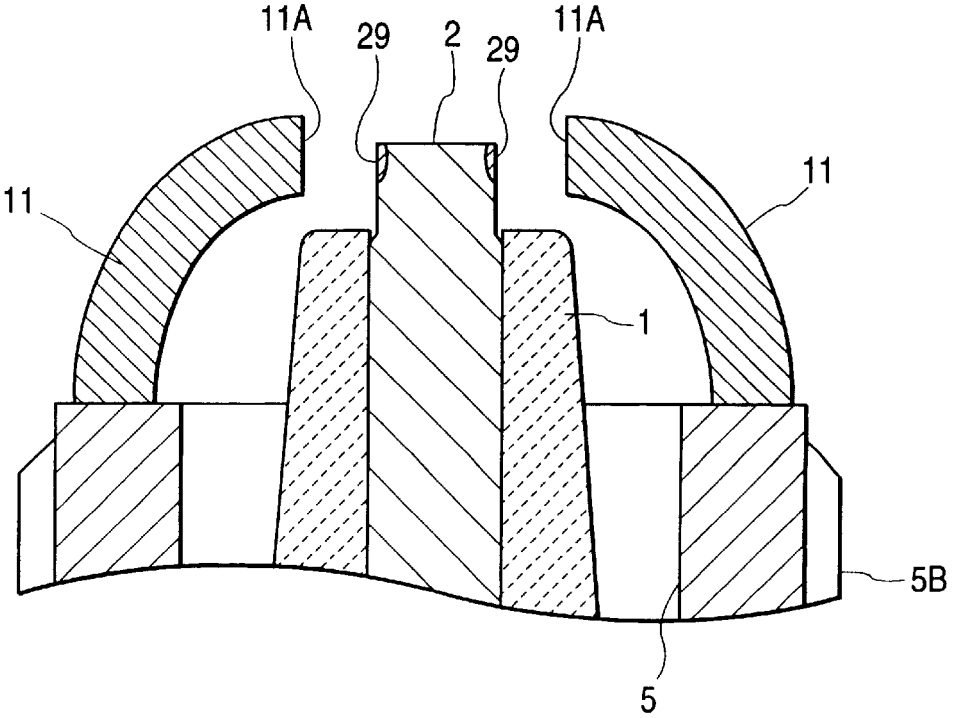
FIG. 10B is a section view showing enlarged a distal end portion of a spark plug according to a eighth embodiment of the present invention.

FIG. 10B is a cross section view of the distal end portion of a spark plug according to an eighth embodiment of the present invention which is identical in shape of the spark plug shown in FIG. 9A, except that the distal end portion of the central electrode 2 is removed by cutting or grinding so that the top end of the anti-spark consumption member 29 in girdle form is exposed from the tip of the central electrode 2. The eighth embodiment has the advantage of allowing an electric field to be easily concentrated at the tip of the central electrode 2 so that more spark jumps occur in the anti-spark consumption member 29 at the tip of the central electrode 2, thus improving the firing performance of the spark plug and making it more resistant to channeling.

Figure 11:
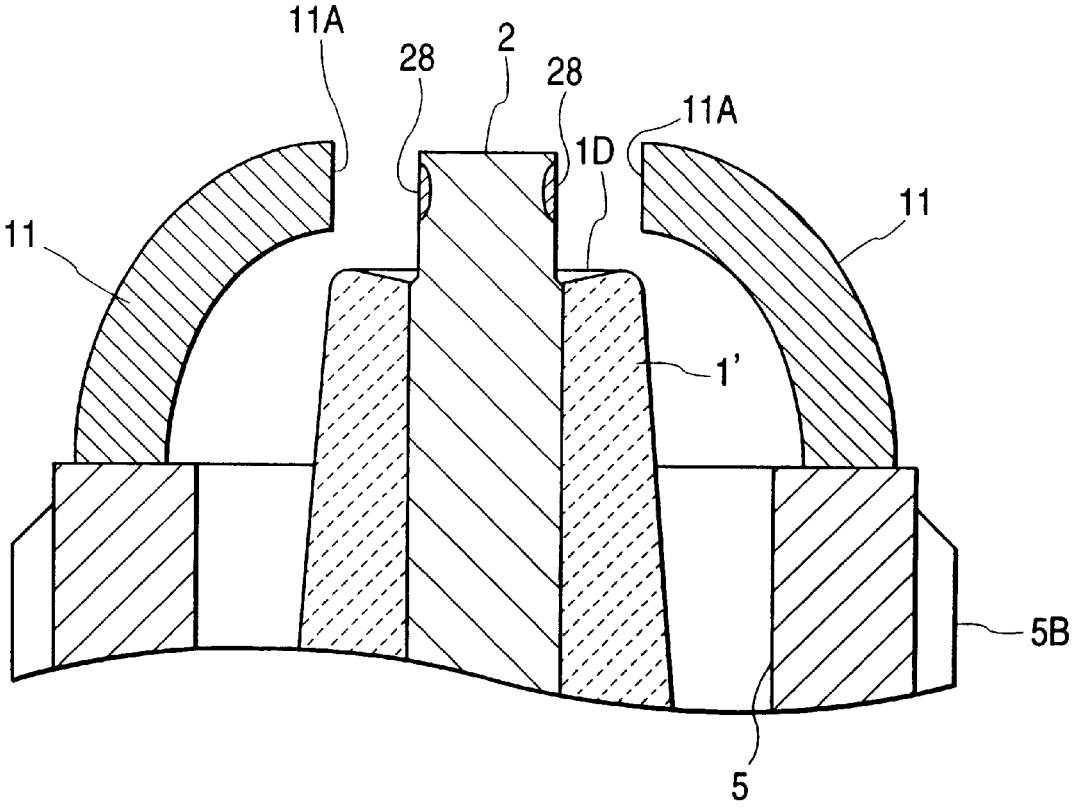
FIG. 11 is a section view showing enlarged a distal end portion of a spark plug according to a ninth embodiment of the present invention.

FIG. 11 is a section of the distal end portion of a spark plug according to a ninth embodiment of the invention. The central electrode 2 and the anti-spark consumption member 28 in the ninth embodiment have the same geometries as those in the seventh embodiment shown in FIG. 10A. The difference is in the geometry of the end face 1D of the porcelain insulator 1'. It is not flat but shaped like an inverted cone that is gouged toward the central electrode 2. The end face 1D which is shaped like an inverted cone increases the distance over which surface discharge occurs on the end face 1D of the porcelain insulator 1', which is accordingly rendered more resistant to fouling and, hence, channeling.

Figure 12A:
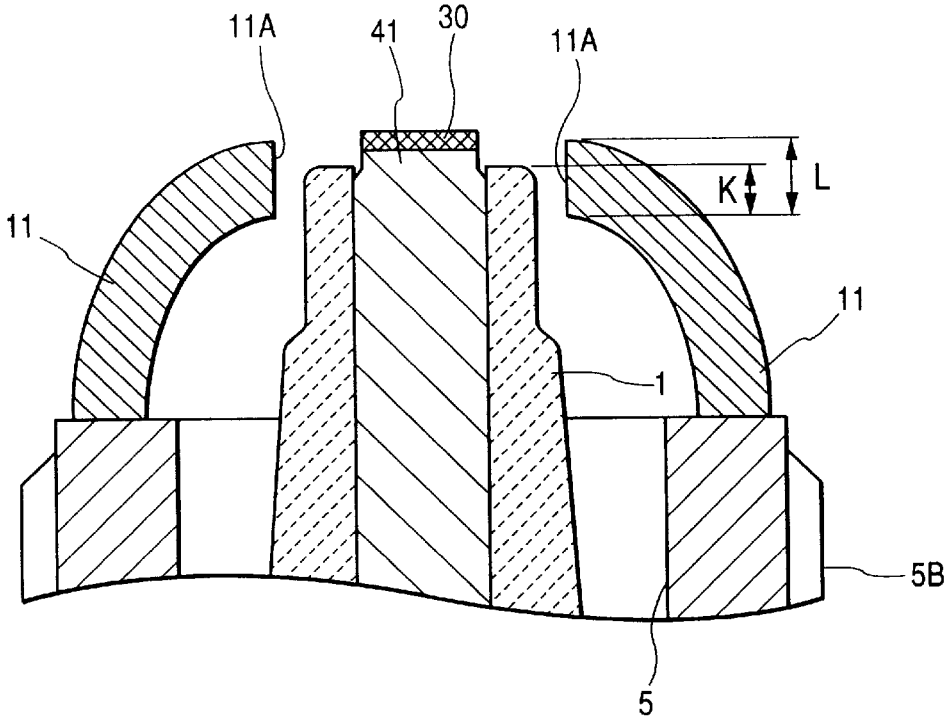
FIG. 12A is a section view showing enlarged a distal end portion of a spark plug according to a tenth embodiment of the present invention.

FIG. 12A is a section view of the distal end portion of a spark plug according to a tenth embodiment of the invention. In this embodiment, the central electrode 41 projects only a little from the end face of the porcelain insulator 1. A disk of anti-spark consumption member 30 is fixed to the distal end face of the central electrode 41 by resistance welding. The end faces of the ground electrodes 11 are opposed to the peripheral side surface of the central electrode 41. The end face of the porcelain insulator 1 is located between the edge of the end face 11A of each ground electrode 11 which is closer to the distal end of the spark plug (and which is at the top of FIG. 12A) and the opposed lower edge of the end face 11A. Thus, the spark plug according to the tenth embodiment is of a so-called semi-surface discharge type. The axial distance K from the end face of the porcelain insulator 1 to the lower edge of the end face 11A of each ground electrode 11 is at least 40% of the thickness of each ground electrode 11 (i.e., the distance from the upper edge of the end face 11A to the lower edge).

With this design, electricity tends to jump from the upper edge of the end face 11A of each ground electrode 11 to the anti-spark consumption member 30 on the central electrode 41 and no sparks will stick to the surface of the porcelain insulator 1; this contributes to make the spark more resistant to channeling.

Figure 12B:
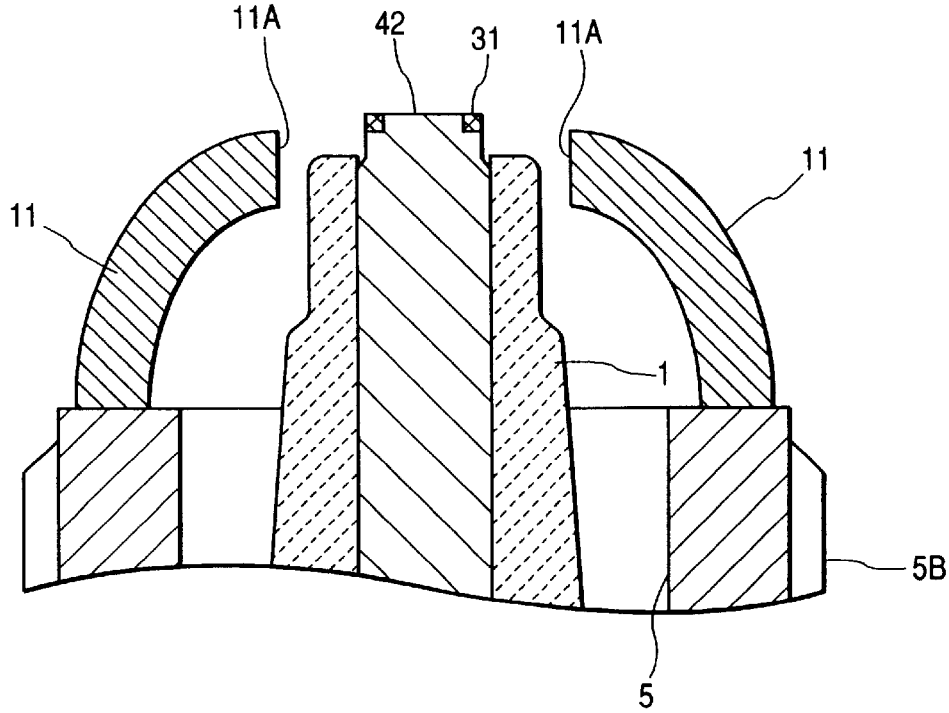
FIG. 12B is a section view showing enlarged a distal end portion of a spark plug according to a eleventh embodiment of the present invention.

FIG. 12B is a section of the distal end portion of a spark plug according to an eleventh embodiment of the invention, in which an annular ring of anti-spark consumption member 31, rather than a disk of anti-spark consumption member, is secured to the tip of the central electrode 42 by laser welding or resistance welding. The eleventh embodiment is otherwise the same as the tenth embodiment shown in FIG. 12A and achieves the same result as the latter. The eleventh embodiment has the advantage of using a smaller amount of the expensive anti-spark consumption member.

Figure 13:
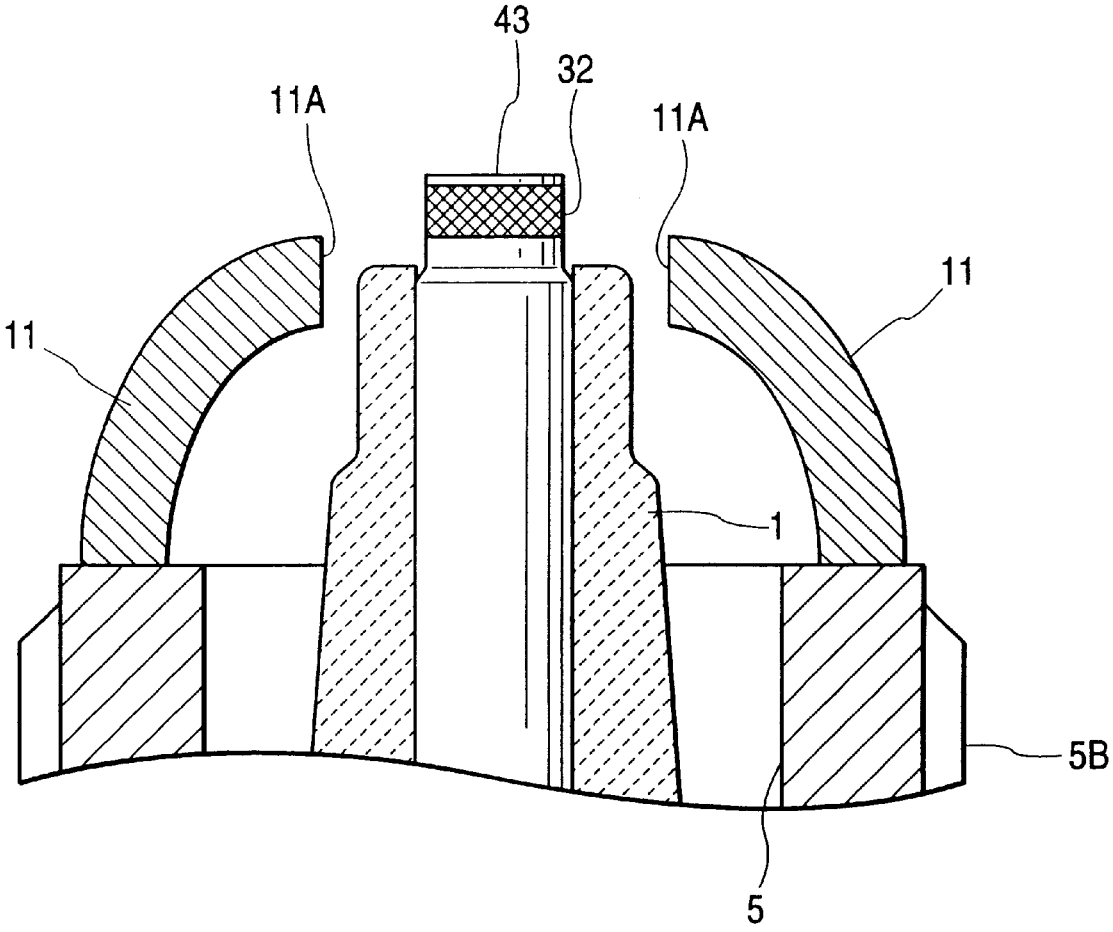
FIG. 13 is a section view showing enlarged a distal end portion of a spark plug according to a twelfth embodiment of the present invention.

FIG. 13 is a cross section of the distal end portion of a spark plug according to a twelfth embodiment of the invention, in which the central electrode 43 projects a little from the end face of the porcelain insulator 1 and a band of anti-spark consumption member 32 is secured to the peripheral side of the central electrode 43 in an area near the tip by laser welding. The twelfth embodiment is otherwise the same as the tenth embodiment.

The foregoing description of the twelve embodiments of the invention has assumed the use of two ground electrodes 11. This is not the sole case of the invention and multi-pole spark plugs may be constructed such as those using three or four ground electrodes. From the viewpoint of anti-fouling performance, multi-pole spark plugs are preferred but, in practice, the manufacturing cost must also be taken into account in order to determine the appropriate number of ground electrodes.

Ordinary spark plugs are in many cases used on negative polarity since they require low voltage. The spark plug of the invention does not experience a considerable increase in the required voltage even if it is used on positive polarity. Therefore, the spark plug can be used on a bipolar power supply to reduce the cost of the ignition system.

As described on the foregoing pages, the spark plug of the invention is so formed that the shortest distance from the end face of each ground electrode to the porcelain insulator is made smaller than the shortest distance from the end face of each ground electrode to the peripheral side surface of the central electrode and the anti-spark consumption member is secured to a portion of the central electrode in such a way that it is spaced at least a specified distance from the end face of the porcelain insulator. Because of these design features, the spark plug of the invention is highly resistant to carbon fouling, suffers from only limited channeling of the porcelain insulator and protects the central electrode from spark consumption, which combine to extend the operating life of the spark plug.

What is claimed is:

1. A spark plug comprising:

a porcelain insulator having a central through-hole;

a central electrode held in said central through-hole, said central electrode having a distal end provided with an anti-spark consumption member;

a metal shell holding said porcelain insulator; and a plurality of ground electrodes, each having an end face, and each ground electrode having electrical continuity to said metal shell, said plurality of ground electrodes forming a spark discharge gap from the distal end portion of said central electrode;

wherein a shortest distance from the end face of each ground electrode to the porcelain insulator is smaller than said spark discharge gap; and said distal end of said central electrode projects from an end face of said porcelain insulator; and said central electrode comprises a central electrode matrix in a plane coextensive with the end face of said porcelain insulator.

2. The spark plug according to claim 1, wherein the end face of said porcelain insulator is spaced from said anti-spark consumption member by a distance of at least 0.2 mm.

3. The spark plug according to claim 1, wherein the diameter of said central electrode is no more than 2 mm.

4. The spark plug according to claim 1, wherein the distal end of said central electrode is located between the edge of the end face of each of said ground electrode that is closer to the distal end of the spark plug and the opposite edge of said end face.

5. The spark plug according to claim 1, wherein each of said ground electrodes is set to be spaced from the porcelain insulator by a distance of at least 0.3 mm.

6. The spark plug according to claim 1, wherein the end face of said porcelain insulator is shaped like an inverted cone that is gouged toward the central electrode.

7. The spark plug according to claim 1, wherein the diameter of said central electrode at the distal end is greater than that of the central electrode at the end face of said porcelain insulator.

8. The spark plug according to claim 1, wherein said anti-spark consumption member is secured to or near the distal end of the central electrode.

9. The spark plug according to claim 1, wherein the axial position of the end face of said porcelain insulator is between the edge of the end face of each ground electrode that is closer to the distal end of the spark plug and the opposite edge of said end face and the axial distance from the end face of the porcelain insulator to the opposite edge of the end face of each ground electrode is at least 40% of the thickness of the end face of each ground electrode (i.e., the distance between the edge of said end face that is closer to the distal end of the spark plug and the opposite edge of said end face).

* * * * *